US005235393A

United States Patent [19]

Merle

[11] Patent Number: 5,235,393

[45] Date of Patent: Aug. 10, 1993

[54] TONER IMAGE-FIXING APPARATUS HAVING AIR COOLING DEVICE

[75] Inventor: Thomas C. Merle, Rochester, N.Y.

[73] Assignee: Eastman Kodak Company, Rochester, N.Y.

[21] Appl. No.: 817,215

[22] Filed: Jan. 6, 1992

[51] Int. Cl.[5] ..... G03G 15/20

[52] U.S. Cl. ..... 355/282; 219/216; 355/285; 355/290; 355/295

[58] Field of Search ..... 385/282, 285, 290, 299, 385/312, 319; 219/216; 355/271, 277; 430/60

[56] References Cited

U.S. PATENT DOCUMENTS

| | | | |
|---|---|---|---|
| 3,762,812 | 10/1973 | Wolff et al. | 355/282 X |
| 3,901,591 | 8/1975 | Mitsumasu | 219/216 X |
| 3,948,215 | 4/1976 | Namiki | 118/60 |
| 4,217,093 | 8/1980 | Steinlehner et al. | 219/216 X |
| 4,462,675 | 7/1984 | Moraw | 355/282 X |
| 4,538,899 | 9/1985 | Landa et al. | 355/282 X |
| 4,668,073 | 5/1987 | Hatabe et al. | 219/216 X |
| 4,780,742 | 10/1988 | Takahashi et al. . | |
| 4,959,693 | 9/1990 | Mitsuya et al. | 355/290 |
| 4,963,943 | 10/1990 | Tamary | 355/290 |
| 4,992,833 | 2/1991 | Derimiggio | 355/282 |
| 5,012,291 | 4/1991 | Buchan et al. | 355/271 |
| 5,023,038 | 6/1991 | Aslam et al. | 264/293 |
| 5,043,749 | 8/1991 | Punater et al. | 346/153.1 |

FOREIGN PATENT DOCUMENTS 0301585 7/1988 European Pat. Off. .

OTHER PUBLICATIONS

U.S. patent application 07/405,258.
U.S. patent application 07/754,489.

*Primary Examiner*—A. T. Grimley
*Assistant Examiner*—T. A. Dang
*Attorney, Agent, or Firm*—Leonard W. Treash

[57] ABSTRACT

An apparatus for fusing toner images to a receiving sheet includes a belt, web or sheet having a hard surface against which the toner image is pressed while at an elevated temperature. The receiving sheet is separated from the hard surface only after the toner image has cooled. A cooling device for cooling the toner image includes an air supply plenum into which cooling air is forced. Walls defining the plenum include a nozzle wall that is parallel to and spaced from a surface of the receiving sheet or belt, web or sheet. A large number of nozzles extend toward the surface being cooled from the nozzle wall for directing air generally perpendicular to the surface being cooled. Air then exhausts from the space between the nozzle wall and the surface being cooled on opposite sides of the path of the receiving sheet.

6 Claims, 3 Drawing Sheets

TONER IMAGE-FIXING APPARATUS HAVING AIR COOLING DEVICE

TECHNICAL FIELD

This invention relates to the fixing of toner images, for example, toner images created electrophotographically. Although not limited thereto, it is particularly useful in fixing color toner images carried on a receiving sheet having a heat-softenable outside layer.

BACKGROUND ART

U.S. Pat. No. 3,948,215 is an example of a large number of references showing belt type fusers in which a toner image carried on a receiving sheet is positioned against a heated endless belt. The belt heats the toner to its glass transition temperature. A pair of rollers applies pressure between the belt and the receiving sheet to fix the toner image to the receiving sheet. After fixing, the toner image is allowed to remain in contact with the belt until it is cooled below its glass transition temperature. At this point, it is separated. See also, European Patent Application 0301585, published Feb. 1, 1989 and European Patent Application 0295901.

U.S. Patent Application 405,258, filed Sep. 11, 1989, in the name of Rimai et al and U.S. Pat. No. 5,023,038, issued June 11, 1991 in the name of Aslam et al, disclose a method and apparatus for fixing a multicolor toner image carried on a heat-softenable outside layer of a receiving sheet. The receiving sheet is preheated to raise the temperature of the thermoplastic layer to its softening point. It is fed into a pressure nip created by a pressure roller in a belt or web backed by a heated roller. The belt or web is a hard ferrotyping material such as stainless steel, nickel or the like. Relatively high pressure is applied between the belt and pressure roller to imbed much or all of the toner image in the thermoplastic layer, fixing the image. The hard ferrotyping belt, combined with the thermoplastic layer, provides photographic quality with an absence of relief and a high gloss. The image and heat-softenable layer remain in contact with the belt as it moves away from the pressure nip. The belt and receiving sheet are allowed to cool until the heat-softenable layer is below its glass transition temperature. At this point, the receiving sheet is separated without offset and without the use of offset-preventing substances like powders or liquids which would reduce the photographic quality of the image.

In designing a continuous production image-forming apparatus, the ferrotyping surface is formed on a web. The web is usually in the form of an endless belt but it is also known to be quite long and to have supply and take-up rolls for continuous operation.

A problem in using a web system, especially an endless belt system in a productive image-forming apparatus is associated with the time required for the belt and image to cool while maintained in contact. If the fixing device is moved at a speed below the speed of the transfer station to allow cooling, then the mismatch of speeds between the transfer station and the fixing device must be accommodated. In general, this requires either a full frame distance in the in-track direction between the transfer station or drum and the fixing device, or a loop or other mechanism absorbing the difference in speeds. Cooling is the critical time-consuming activity that forces these accommodations.

A number of references suggest actively cooling the belt and receiving sheet combination to reduce the necessary size of the belt required. U.S. Pat. Nos. 4,780,742 and 3,948,215 suggest air cooling the belt and receiving sheet after it leaves the pressure-applying members. See also, U.S. Pat. Nos. 5,012,291; 3,356,831; 3,948,215; "Belt Fusing Device", *Research Disclosure*, July 1990, page 559; and U.S. Pat. application Ser. No. 07/754,489, filed Sep. 3, 1991 to J. P. Swapceinski et al.

U.S. Patent application Ser. No. 783,475 to Johnson and Merle, entitled "IMAGE-FORMING APPARATUS INCLUDING TONER IMAGE FIXING DEVICE USING FUSING SHEETS", filed Oct. 28, 1991, suggests using a finite or a cut fusing sheet instead of an endless belt, which fusing sheet can form a sandwich with the receiving sheet, which can be moved much slower or not at all during the cooling process after leaving a pair of pressure members that can be allowed to run at full machine speed.

DISCLOSURE OF THE INVENTION

It is an object of this invention to provide a toner image-fixing apparatus of the general type described above in which a toner image is fixed to a receiving sheet and is cooled before separation from a hard surface of a belt, web or sheet, but with improvement in the efficiency of the cooling portion of the apparatus.

This and other objects are accomplished by an air cooling mechanism that directs air at one of the outside surfaces of either the receiving sheet or the web, belt or sheet after the image has been fixed to the receiving sheet for separation. The air cooling device includes wall means defining an air supply chamber or plenum having a nozzle wall generally parallel to and spaced from the outside surface and an inlet means for receiving air from a forced air supply. A plurality of rows of nozzles extend toward the outside surface from the nozzle wall, each nozzle defining an orifice from the air supply chamber directed generally perpendicular to the outside surface.

The extension of the nozzles toward the outside surface assures high air speed at the surface while still allowing substantial room for air to exit the space between the outside surface and the nozzle wall. According to a preferred embodiment, the nozzles are closely spaced across the entire cross-track direction of the receiving sheet, preferably, arranged in staggered rows. This provides cooling air at virtually every point along the outside surface as distinguished from lower angle air flows. At the same time, the substantial separation of the nozzle wall and the outside wall allows ready exit of the air as it warms.

According to a further preferred embodiment, the nozzles define orifices which narrow toward the outside surface. A broader or conical vertical cross section of the orifice at the interface with the air supply chamber contributes to good flow of air from the chamber into the nozzle, while the narrowness of the nozzle at the exit of the nozzle increases the speed of the air, causing it to impinge on, and cool, the outside surface before it has a chance to warm.

BEST MODE OF CARRYING OUT THE INVENTION

Figure 1:
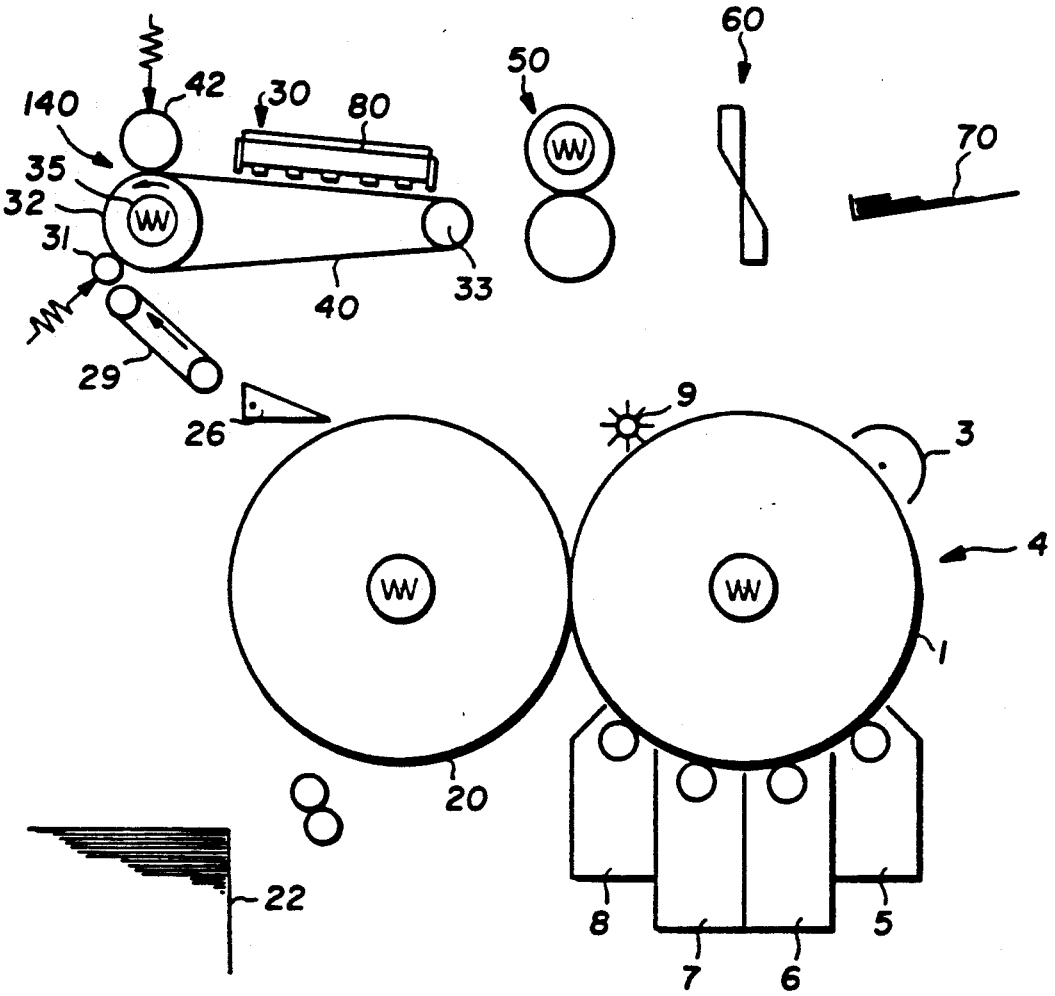
FIGS. 1 and 2 are side schematics of different types of image-forming apparatus utilizing the invention.

According to FIG. 1, an image-forming apparatus includes an image member, for example, a photoconductive drum 1 which is rotatable past a series of stations. The periphery of drum 1 is uniformly charged at a charging station 3 and imagewise exposed at an exposure station, for example, laser 4, to create a series of electrostatic images. The series of electrostatic images are toned by different ones of toner stations 5, 6, 7 and 8 to create a series of toner images. Each toner image is toned by a different color toner to create a series of toner images of different colors. The toner images are transferred to an image surface of a receiving sheet fed from a receiving sheet supply 22 to the periphery of a transfer drum 20, in registration, to form a multicolor image on the receiving sheet.

Although the transfer can be accomplished by conventional electrostatic transfer to an image surface of a plain paper receiving sheet, best results are obtained by thermally-assisted transfer to a receiving sheet having a heat-softenable layer deferring the image surface. After transfer of all toner images in the series of toner images has created the desired multicolor image on the receiving sheet, the receiving sheet is stripped from transfer drum 20 by an articulatable skive 26 and is transported by a sheet transport 29 to a fusing apparatus or fuser 30.

Fuser 30 includes a fusing belt 40 supported by a pair of rollers 32 and 33 and driven in a generally clockwise direction as seen in FIG. 1 by suitable means, not shown. Preferably, the belt 40 has a hard ferrotyping surface facing away from the rollers 32 and 33. For example, it could be made of nickel, stainless steel or other metals. See U.S. Pat. No. 5,023,038 for a description of other materials suitable for belt 40. Roller 32 is internally heated by a lamp 35 to a temperature above the glass transition temperature of the toner making up the multicolor toner image on the receiving sheet. The image is preheated by being pushed by a small roller 31 into contact with belt 40 where the belt is backed by roller 32. The toner image softens in contact with belt 40 and generally causes the receiving sheet to adhere to the belt as the belt passes around roller 32 and into a nip 140 with a pressure roller 42. Pressure roller 42 and heated roller 32 are urged toward each other sufficiently to provide enough pressure to fix the softened toner image to the receiving sheet. If the receiving sheet has a heat-softened thermoplastic layer into which the toner has been partially imbedded by the transfer process, that layer also is softened by the heat from lamp 35 as the receiving sheet passes from roller 31 to the nip 140. In this instance, the pressure between rollers 42 and 32 cause further imbedding of the toner image into the heat-softened layer to reduce any relief image that was present after the transfer process.

As the receiving sheet leaves the nip 140, both the toner image and any heat-softenable layer are above their glass transition temperatures and are essentially stuck to the belt 40. The receiving sheet is separated from the belt as the belt goes around relatively small roller 33. To prevent offset, the toner and any heat-softenable layer must be cooled below their glass transition temperatures by the time they reach roller 33. An air cooling device 80 is provided to direct air at the back or outside surface of the receiving sheet as the receiving sheet and belt move together from nip 140 to roller 33. This device will be described in more detail with respect to FIGS. 3, 4 and 5.

After the receiving sheet leaves belt 40 at roller 33, it can pass through further treatment stations, for example, a texturizing station 50 and a cutting station 60 and, ultimately, into an output hopper 70.

Rapid cooling of the toner image and any heat softenable layer of the receiving sheet is critical to the design of the image-forming apparatus. If cooling takes a substantial time, either the belt 40 must be slowed down or made much longer. Slowing down the belt forces it to a slower speed than the speed of transfer drum 20, which then requires accommodation for the difference in speeds between the drum 20 and fixing apparatus 30. Whichever approach is used, the image-forming apparatus is necessarily made larger, something very undesirable in this application.

Figure 3:
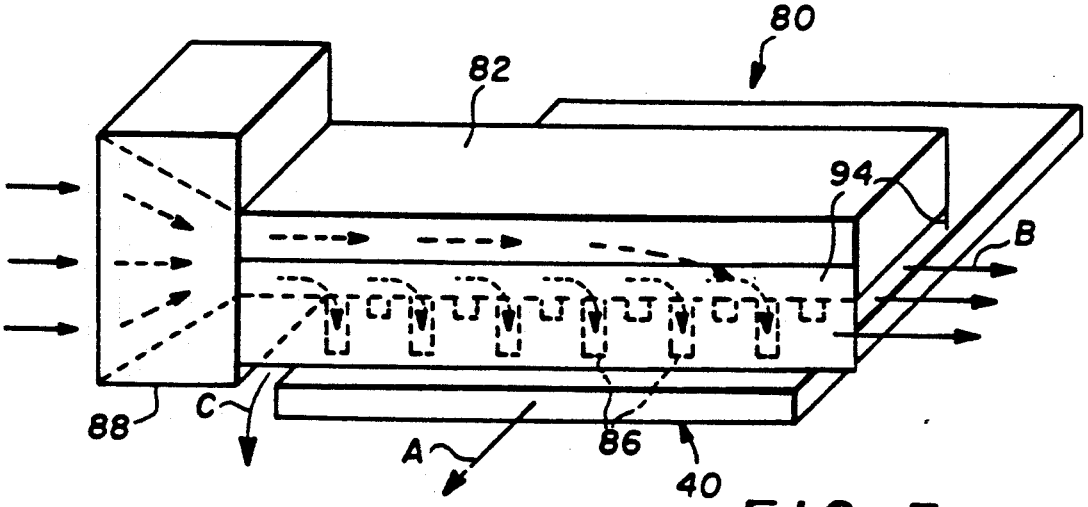
FIGS. 3 and 4 are perspective and bottom views, respectively, of a cooling device constructed according to the invention.
Figure 4:
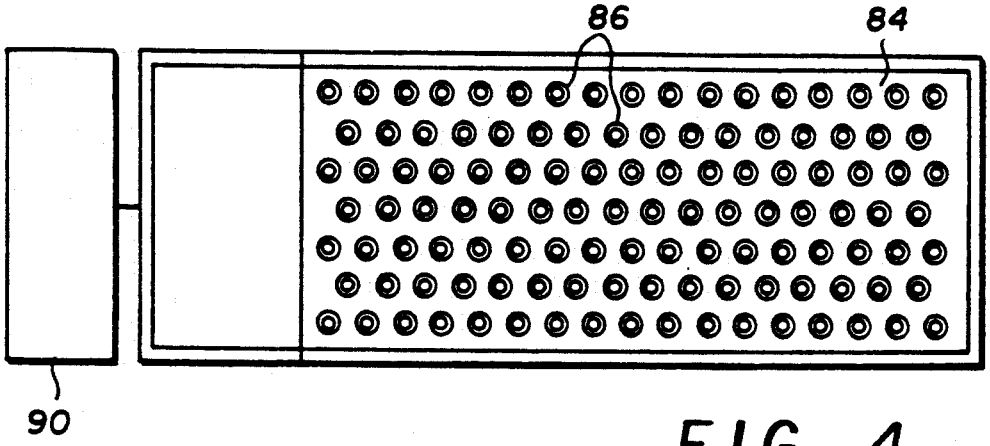

Referring to FIGS. 3 and 4, air cooling device 80 includes a set of walls which define an air supply chamber of plenum 82 which is sized to fully cover the cross-track dimension of the belt 40 and the receiving sheet. For example, using a receiving sheet that is 12"×18", the plenum 82 has a length of at least 12". The walls defining the plenum include a bottom or nozzle wall 84. The nozzle wall 84 is spaced from the belt and is generally parallel to it. A number of nozzles 86 are positioned in staggered rows in the nozzle wall and extend from the nozzle wall toward an outside surface of the belt and receiving sheet combination. As shown in FIG. 4, seven rows of more than 15 nozzles each are placed in the nozzle wall. The rows are staggered to assure air flow to the entire width of the receiving sheet as it passes under them in the direction of arrow A. Preferably, the nozzles are arranged in at least two staggered rows, each row having at least one nozzle per inch across the direction of movement of the outside surface being cooled. The nozzles 86 extend at least a ¼" below the nozzle wall 84 and into very close proximity with the outside surface of the receiving sheet or belt. For example, the nozzles preferably extend ⅜" below the nozzle wall to within ¼" of the outside surface.

These dimensions and this concentration of nozzles allows a substantial amount of cooling air to be directed perpendicularly at the outside surface. The close proximity of the end of the nozzle to the surface being cooled prevents the air from being slowed down and heated prior to impingement on the surface. The separation between the bottom of the nozzle wall 84 and the outside surface provides ample space for air to exit the area without obstruction. As seen in FIG. 3, air can exit at either end of the walls defining plenum 82, as shown by arrows B and C.

Figure 5:
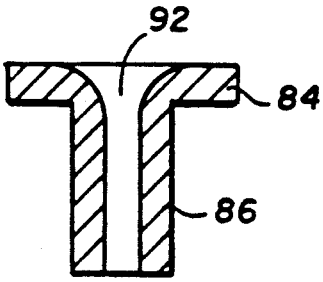
FIG. 5 is a section of a cooling nozzle portion of the apparatus shown in FIGS. 3 and 4.

Air is fed into the plenum 82 by centrifugal blower or other air supply mechanism 90 which directs air into an inlet 88 having a converging shape which increases the speed of the air as it enters the plenum 82. As seen in FIG. 5, each nozzle 86 has an orifice 92 that is generally conically shaped at the entrance but narrows at its outlet 82. This configuration causes relatively unrestricted flow into the orifice 92 from the plenum but greatly increases the speed of the air toward its exit so that it will rapidly impinge on the surface being cooled and then exhaust to the sides, as shown in FIG. 3 by arrows B and C. Each of the nozzles can be positioned in a suitable counterbore in the nozzle wall 84, which is essentially the bottom sheet defining the plenum.

With this structure, all portions of the surface being cooled (herein sometimes called the "outside surface") have high velocity cooling air directly impinging on it. At the same time, the air is not substantially restricted in flowing out of that area as it warms.

To restrict the air flowing away from the cooling area without affecting other parts of the apparatus, a shield 94 can be placed across the path of the belt 40 as it moves in its in-track direction (arrow A).

The exit location of the nozzles and the nozzle flow velocity are purposely designed to create a high velocity and a high heat transfer coefficient at the belt or receiving sheet surface. With a large number of these nozzles impinging on the belt, the heat transfer characteristics are very uniform. The nozzles are specifically designed to extend below nozzle wall 84. This extension allows the exhaust area for the air to be greater than if the nozzles were flush with wall 84, and thus reduces the exhaust air velocity and pressure drop. In addition, the nozzles are aligned in the direction of the air flow exhaust so as to further reduce the pressure drop.

The large exhaust area, the close proximity of the nozzles to the belt, the design of the plenum and the velocity of the air through the nozzles all contribute to increased heat transfer and reduced pressure drop.

The heated exhaust air could be used as a source of thermal energy in a region of the machine or subsystem that needs to be heated to improve the overall efficiency of the machine. The use of such heated air in copiers and printers is generally known.

Figure 2:
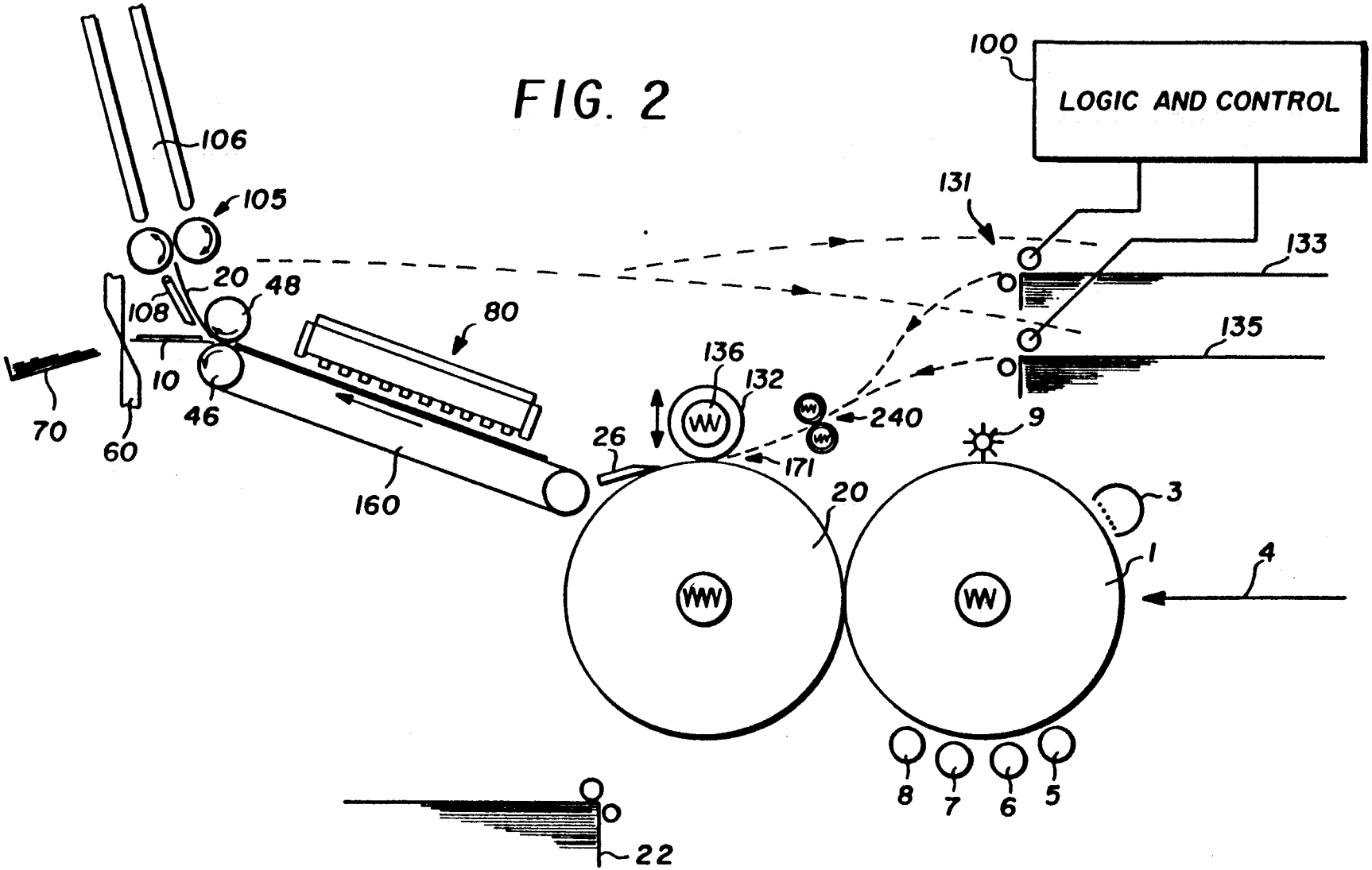

FIG. 2 shows an alternative embodiment with an image-forming apparatus in which the hard surface used in fusing is not part of a belt or elongated web. According to FIG. 2, the multicolor images are formed on a receiving sheet on transfer drum 20 as in FIG. 1. A fusing sheet replaces belt 40. It is similar to belt 40 except that it is a discrete sheet having a leading edge and a trailing edge. Like belt 40, it has at least one hard, preferably metallic, surface. It is fed from a fusing sheet supply 131 through a pair of preheating rollers 240 into a nip 171 at substantially the same time that the receiving sheet enters the nip. Nip 171 is formed by fusing roller 132 and transfer drum 20. Roller 132 has an internal heat lamp 136 and presses the two sheets together to fix the toner image to the receiving sheet. This sandwich of sheets, which is stuck together because the softened toner (as well as any softened receiving sheet layer) is separated from drum 20 by articulatable skive 26 and fed to a transport device 160. Transport device 160 moves the sandwich toward a pair of separation rollers 46 and 48 while it is cooled by an air cooling device 80 constructed substantially as shown in FIGS. 3–5.

The receiving sheet and the fusing sheet are separated as they exit the nip between rollers 46 and 48, and the fusing sheet is fed into a turnaround area 106 by a pair of reversible rollers 105 and ultimately directed by a pall 108 back to fusing sheet supply 131. The receiving sheet passes on to cutter 60 and ultimately to output tray 70, as in the FIG. 1 embodiment.

The fusing sheet supply 131 has separate subsupplies 133 and 135 to accommodate different textured (or sized) fusing sheets as controlled by a logic and control 100.

Note that in the FIG. 2 embodiment, the cooling device concentrates its air on the outside surface of the fusing sheet, while in the FIG. 1 embodiment the air is directed at the outside surface of the receiving sheet. It would be clear to somebody skilled in the art that the choice of which outside surface to cool is determined by a number of considerations, including the space available, the need to reheat belt 40, and the ability of the respective sheets to transfer heat from the outside surface to the toner image (and any heat-softenable layer). The cooling device shown in FIGS. 3–5 is well adapted to be positioned on either or both sides of the fusing belt, web or sheet and receiving sheet combination.

The invention has been described in detail with particular reference to a preferred embodiment thereof, but it will be understood that variations and modifications can be effected within the spirit and scope of the invention as described hereinabove and as defined in the appended claims.

I claim:

1. Apparatus for fusing a toner image to a receiving sheet comprising:

means for positioning the toner image between an image surface of the receiving sheet and a hard surface of a belt, web or sheet, means for heating or maintaining the toner image to at least its glass transition temperature, means for urging the image surface and hard surface together with sufficient pressure to fix the heated toner image to the receiving sheet, means for cooling the heated toner image below its glass transition temperature while the image surface and hard surface remain together, and means for separating the receiving sheet from the hard surface, characterized in that the means for cooling includes means for directing air at an outside surface of one of the belt, web, sheet or receiving sheet not contacting the heated toner image, said means including:

wall means defining an air supply plenum or chamber, said wall means including a nozzle wall generally parallel to and spaced from said outside surface, and said wall means further defining an inlet for receiving air from an air supply, and a plurality of rows of nozzles extending toward said outside surface at least ¼ inch from said nozzle wall, each nozzle defining an orifice from said air supply chamber directed generally perpendicular to and closely spaced from said outside surface.

2. Apparatus according to claim 1 wherein each of the nozzles defines an orifice that is wider at its interface with the air supply chamber than at its exit.

3. Apparatus according to claim 1 further including means for moving the receiving sheet and the belt, web or sheet in a direction of travel and wherein the nozzles are positioned in staggered rows across said direction of travel.

4. Apparatus according to claim 3 wherein said nozzles are arranged in at least two staggered rows, each row having at least one nozzle per inch across the direction of travel.

5. An air cooling device for cooling a moving surface, said device comprising:

wall means defining an air supply plenum or chamber, said wall means including a nozzle wall generally parallel to and spaced from said moving surface, and said wall means further defining an inlet for receiving air from an air supply, and a plurality of staggered rows of nozzles extending at least ¼" below the nozzle wall to within ¼" of the moving surface, each row of nozzles having at least one nozzle to the inch across the direction of movement of the moving surface, and each nozzle defining an orifice from said air supply chamber directed generally perpendicular to the moving surface.

6. The device according to claim 5 wherein each nozzle defines an orifice that is wider at its entrance from the chamber than at its exit.

* * * * *